US008486601B2

(12) United States Patent
Hosoya et al.

(10) Patent No.: US 8,486,601 B2
(45) Date of Patent: Jul. 16, 2013

(54) TONER FOR ELECTROSTATIC LATENT IMAGE DEVELOPMENT AND IMAGE FORMING METHOD

(75) Inventors: Yukio Hosoya, Tokyo (JP); Mikio Kouyama, Tokyo (JP); Kenji Hayashi, Tokyo (JP); Hiroaki Obata, Tokyo (JP); Koji Shibata, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 398 days.

(21) Appl. No.: 12/883,305

(22) Filed: Sep. 16, 2010

(65) Prior Publication Data

US 2011/0070535 A1 Mar. 24, 2011

(30) Foreign Application Priority Data

Sep. 24, 2009 (JP) ..... 2009-218586

(51) Int. Cl.
*G03G 9/00* (2006.01)
*G03G 9/08* (2006.01)

(52) U.S. Cl.
USPC ..... 430/123.51; 430/108.3; 430/137.11

(58) Field of Classification Search
USPC ..... 430/123.51, 108.3, 137.11
See application file for complete search history.

(56) References Cited

U.S. PATENT DOCUMENTS

2005/0214671 A1* 9/2005 Mizutani et al. ..... 430/111.35

FOREIGN PATENT DOCUMENTS

| | | |
|---|---|---|
| JP | 06266152 | 9/1994 |
| JP | 07261446 | 10/1995 |
| JP | 10-330488 | * 12/1998 |
| JP | 2005173480 | 6/2005 |

OTHER PUBLICATIONS

Machine Translation of JP10-330488.*

* cited by examiner

*Primary Examiner* — Thorl Chea
(74) *Attorney, Agent, or Firm* — Lucas & Merchanti, LLP

(57) ABSTRACT

A toner for electrostatic latent image development is disclosed comprising colored particles containing a binder resin and a colorant and external-additive particles attached to the surfaces of the colored particles, wherein the external-additive particles comprise resin particles covered with an inorganic layer, and the resin particles are bound to the inorganic layer by a siloxane bond. A preparation method of the toner is also disclosed.

9 Claims, No Drawings

TONER FOR ELECTROSTATIC LATENT IMAGE DEVELOPMENT AND IMAGE FORMING METHOD

This application claims priority from Japanese Patent Application No. 2009-218586, filed on Sep. 24, 2009, which is incorporated hereinto by reference.

FIELD OF THE INVENTION

The present invention relates to a toner for electrostatic latent image development and an image forming method by use of the same.

BACKGROUND OF THE INVENTION

Recently, further downsizing of an apparatus, resource saving in response to ecology and cost reduction have been desired for electrophotographic printers and copiers.

Methods to solve these problems include lowering the fixing temperature and there have been attempted, as an achieving means therefore, a lowering of the molecular weight of a binder resin constituting a toner, depression of glass transition point (Tg) and increasing the content of a wax contained in a toner.

However, a molecular weight lowering or glass transition point depression of a binder resin leads to a depression of the melting temperature but results in deteriorated storage stability of the toner, and specifically under an environment of high temperature, cohesion onto a developing device or fusion of toner particles results and leading to a lowering of fluidity. As a result, the initial rise of electrostatic charging is lowered, resulting in scattering of the toner or occurrence of fogging.

There have been made some proposals to overcome these problems. For instance, there was disclosed a technique of adding organic particles of 50-200 nm to toner particles to effectuate a spacer function, as disclosed in JP 06-266152A. In that case, the use of spherical organic particles enables to effectuate a spacer function in the early stage. However, such organic particles are rare in burial or liberation due to stress with aging but the particles themselves deform, rendering it difficult to stably maintain enhanced spacer function over a long period of time.

On the other hand, JP 07-261446A disclose a technique of adding a large-particulate silica in addition to small-particulate silica, as a fluidizing agent. According to the disclosure, adhesion between toner particles was prevented by a spacer effect of the large-particulate silica, thereby inhibiting fusion of toner particles and restraining fogging. However, it was proved that a large-particulate silica of more than 100 nm caused scattering of toner particles or resulted in a lowering of fixability or image defects such as white spots or white streaks. This is supposed to be due to the fact that silica, being heavy in true specific gravity, results in increased liberation from toner particles along with increased particle size.

To overcome these problems, there were proposed silica capsule particles in which resin particles were covered with a silica layer through a sol-gel method, as disclosed in JP 2005-173480A. Silica capsule particles obtained by the sol-gel method exhibit a relatively low specific gravity and satisfactory initial performance of a toner, such as fluidity, electrostatic chargeability, developability, transferability and fixability can be achieved by subjecting them to an external-addition treatment. However, there were produced problems such that silica layer coverage was stripped after being used over a long duration, resulting in deteriorated fluidity and rendering it difficult to attain the desired image density. Specifically, deterioration in durability was marked when the particle size of an external additive became 80 nm or more.

SUMMARY OF THE INVENTION

As described earlier, when silica capsule particles of resin particle being covered with silica are used over a long period of time, peeling-off of an inorganic layer is caused. As a result, since such an inorganic layer (that is, a silica layer) and the resin are physically adhered to each other, the resin surface is exposed and thereby, the fluidity of toner particles is lowered, resulting in reduced transferability of toner particles within a developing device and leading to a lowering of image density.

Accordingly, it is an object of the present invention to provide a toner for electrostatic latent image development and an image forming method by use thereof.

One aspect of the invention is directed to a toner for electrostatic latent image development comprising colored particles which contain a binder resin and a colorant, and external-additive particles having been added onto the surfaces of the colored particles, wherein the external-additive particles comprise resin particles covered with an inorganic layer and the resin particles are bound to the inorganic layer by a siloxane bond.

Another aspect of the invention is directed to a method of preparing a toner for electrostatic latent image development comprising the steps of forming colored particles containing a binder resin and a colorant, and adding external-additive particles to the colored particles to form toner particles with the external-additive particles attached to the surfaces of the colored particles, wherein the external-additive particles comprise resin particles covered with an inorganic layer.

Another aspect of the invention is directed to an image forming method comprising the steps of forming an electrostatic latent image, developing the electrostatic latent image with a toner to form a toner image, transferring the toner image to a transfer material, and heat-fixing the transferred toner image, wherein the toner is a toner as claimed in claim 1.

In the invention, resin particles (parent particles) and an inorganic layer are bound through a siloxane bond. Namely, the resin particles and the inorganic layer are bonded through a chemical bond so that adhesion of the resin particles to the inorganic layer is enhanced, and peeling of the inorganic layer is prevented without causing a lowering of fluidity of toner particles over a long duration, whereby enhanced stable image density is obtained.

Thus, in the present invention, there can be provided a toner for electrostatic latent image development which can obtain stable image densities over a long period of time and an image forming method by use of the same.

DETAILED DESCRIPTION OF THE INVENTION

The present invention will be further described in detail.

In the prior art, resin particles and an inorganic layer (silica layer) are physically bonded and on the contrary, in the present invention, resin particles and an inorganic layer are bonded through a siloxane bond. Specifically, a functional group capable of siloxane-bonding (e.g., an alkoxysilyl group) is introduced to a resin and thereby, the resin is bonded to an inorganic layer (silica layer) through siloxane bond.

The siloxane bond refers to bonding of silicon with oxygen, represented by the chemical formula of Si—O and the alkoxysilyl group (also denoted simply as an AOS group) is a mono-valent silyl group, represented by the chemical formula of —$Si(OR^1)_n(R^2)_{3-n}$, wherein $R^1$ and $R^2$ are each an alkyl group having carbon atoms of 1 to 3, and n is an integer of 1 to 3.

Specific examples of an alkoxysilyl group include a trimethoxysilyl group, triethoxysilyl group, tripropoxysilyl group, methyldimethoxysilyl group, methyldiethoxysilyl group, ethyldiethoxysilyl group, propyldiethoxysilyl group, dimethylmethoxysilyl group, dimethylethoxysilyl group, diethylethoxysilyl group and dipropylethoxysilyl group.

The external-additive particles of the invention can be prepared by forming an inorganic layer on the surfaces of parent particles having introduced an alkoxysilyl group (or AOS group) by a wet process. Examples of a method of introducing an AOS group onto the parent particle surface include: an introduction method (1) of introducing an AOS group to a resin constituting a parent particle and an introduction method (2) in which a functional group is introduced to a resin constituting the parent particle surface and a compound having a group reactive to the functional group and thereby an AOS group is reacted. On the other hand, a forming method of an inorganic layer is typically a sol-gel method.

To confirm the siloxane bond of external-additive particles in the invention, the presence of a Si element is simply confirmed, whereby an AOS group contained parent particles is ascertained.

Specifically, it is confirmed in such a manner as below. External-additive particles are sufficiently dispersed in an acryl resin which is curable at ordinary temperature, and after being embedded and solidified, a thin sample piece is cut out by using a microtome installed with a diamond cutter. Among the thus obtained particle sections, the section of a particle which is close to the average particle size and capable of ascertain the interior is chosen and using a transmission electron microscope (JEM 2010F, made by Nippon Denshi Co., Ltd.) and an energy dispersion type X-ray analyzer (System SIX, made by Thermo Noran), the element mapping measurement of a resin portion is conducted at an acceleration voltage of 200 kV and a magnification capable of observing the whole of a particle to confirm the existing position of a Si element.

When a silicon element is confirmed inside an external-additive particle, that is, in a parent particle of an external-additive, it is judged to be assigned to an AOS group.

The number average particle size of particulate external-additive in which a resin particle and an inorganic layer are bonded via a siloxane bond, is preferably from 30 to 500 nm, and more preferably from 80 to 200 nm in terms of spacer effect and solidification onto a toner particle.

The number average particle size of an external-additive is determined in the manner that electron-micrographs are taken in an electron microscope at a magnification of 100,000 fold, and the Feret diameter in the horizontal direction is calculated with respect to at least 100 particles of an external-additive and their average value is defined as the number average particle size.

Introduction of AOS Group to Parent Particle:

Methods of introducing an AOS group to parent particles include, for example, a method (1) of introducing an AOS group to a resin constituting parent particles, and a method (2) in which a functional group is introduced to a constituent resin for parent particles and after preparing parent particles by using the resin, a functional group on the parent particle surface is reacted with a compound containing a group reactive with the functional group and an AOS group.

The introducing site of an AOS group may be any portion within a parent particle and the AOS group is allowed to exist preferably in the vicinity of the particle surface in terms of reactivity of a siloxane bond.

Introduction Method (1):

In the introduction method (1), introducing an AOS group into a constituent resin for parent particles results in introduction of the AOS group onto the parent particle surface. In detail, an AOS group-containing resin is synthesized by using an AOS group-containing monomer as a monomer constituting a resin of parent particles and parent particles containing the AOS group-containing resin are prepared.

Examples of such an AOS group-containing resin constituting parent particles include an olefinic resin, a polyester resin and the like.

An AOS group-containing olefinic resin can be obtained by using an AOS group-containing radical-polymerizable monomer. Such an AOS group-containing radical-polymerizable monomer may be any monomer containing an AOS group and a radical-polymerizable group, but it is preferred to use a radical-polymerizable monomer containing an AOS group at the end of a side chain to readily achieve bonding between a parent particle and an inorganic layer.

Specific examples of an AOS group-containing radical-polymerizable monomer include styrylmethoxysilane, styrylethoxysilane, 3-methacryloxypropylmethyldimethoxysilane, 3-methacryloxypropyltrimethoxysilane, 3-methacryloxypropylmethyl-diethoxysilane, 3-methacryloxypropyltriethoxysilane, 3-acryloxypropylmethyldimethoxysilane, 3-acryloxypropylmethyl-trimethoxysilane, 3-acryloxypropylmethyldiethoxysilane, 3-acryloxypropylmethoxysilane, vinyltrimethoxysilane and vinyltriethoxysilane.

Examples of a radical-polymerizable monomer other than an AOS group-containing radical polymerizable monomer, capable of constituting an AOS group-containing olefinic resin include styrene, (meth)acrylic acid, alkyl (meth)acrylate, butadiene, isoprene, and propylene.

Parent particles may contain an AOS group-free resin not containing an AOS group. Such an AOS group-free resin may use an AOS group-free resin conventionally contained parent particles, including, for example, an olefinic resin and a polyester resin.

The content of an AOS group-containing monomer is not specifically limited so long as the object of the invention is achieved but is preferably within the range of 1 to 50% by mass of all of monomers constituting total resins of parent particles, and more preferably 3 to 30% by mass.

In the introduction method (2), parent particles having introduced an AOS group onto the surface are prepared in the manner as below:

(1A) At least an AOS group-containing radical polymerizable monomer is mechanically stirred in an aqueous medium to form droplets, followed polymerization to prepare parent particles;

(1B) At least an AOS group-containing radical-polymerizable monomer is dropwise added to an aqueous medium containing a surfactant to perform polymerization within a micelle to form polymer particles of 100 to 150 nm and a coagulant is added thereto to allow these particles to coagulate and fuse to prepared parent particles.

Introduction Method (2):

In the introduction method (2), first, a functional group is introduced into a resin as a constituent for parent particles, whereby such a functional group is introduced to the parent particle surface. Specifically, using a functional group-containing monomer, a functional group-containing resin is synthesized, whereby parent particles composed of such a functional group-containing resin are prepared.

Subsequently, the functional group on the parent particle surface is reacted with a compound containing a group reactive to the functional group and an AOS group, whereby the AOS group is introduced to the parent particle surface.

Examples of such a functional group introduced into parent particles include an epoxy group, an amino group, an isocyanate group, and a thiol group.

Examples of a functional group-containing resin, as a constituent for parent particles include an olefinic resin and a polyester resin.

A functional group-containing olefinic resin can be obtained by using a functional group-containing radical polymerizable monomer. Such a functional group-containing olefinic resin is not specifically limited and may be any one containing a functional group and a radical polymerizable group, but it is preferred to use a radical-polymerizable monomer containing a functional group at the end of a side chain to readily achieve bonding between a parent particle and an inorganic layer.

Specific examples of a radical-polymerizable monomer containing a functional group include an epoxy group-containing radical-polymerizable monomer such as 3-glycidyl methacrylate or 3-glycidyl acrylate; an amino group-containing radical-polymerizable monomer such as aminostyrene, diethylaminoethyl acrylate, or diethylaminoethyl methacrylate; an isocyanate group-containing radical-polymerizable monomer such as 2-methacryloyloxyethyl isocyanate or 2-acryloyloxyethyl isocyanate; a thiol group-containing radical-polymerizable monomer such as laurylmercaptane or octyl thioglycolate.

A radical-polymerizable monomer other than a functional group-containing radical-polymerizable monomer capable of constituting a functional group-containing olefinic resin includes, for example, a monomer similar to one exemplified as another radical-polymerizable monomer capable of constituting a AOS group-containing olefinic resin.

A functional group-free resin containing no functional group may be contained in a parent particle. As such a functional group-free resin is usable a functional group-free resin which was originally contained in a parent particle, and including, for example, an olefinic resin and a polyester resin.

The content of a functional group-containing monomer is not specifically limited so far as the object of the invention is achieved but is preferably within the range of 0.1 to 30% by mass of all of monomers constituting total resins of parent particles, and more preferably 1 to 15% by mass.

Parent particles having introduced a functional group on the particle surface can be prepared in the same manner as the parent particles having introduced an AOS group in the introduction method (1), except that a functional group-containing resin is used in place of an AOS group-containing resin and a functional group-containing, radical-polymerizable monomer is used in place of an AOS group-containing, radical-polymerizable monomer.

Examples of a group (hereinafter, also denoted as a functional group A) capable of reacting with a functional group on the parent particle surface (hereinafter, also denoted as a reactive group B) include an amino group, an isocyanate group, an epoxy group and a thiol group. Specifically, for example, in cases when the functional group A is an epoxy group, the reactive group B may use an isocyanate group, an epoxy group or a carboxyl group. Further, in cases when the functional group A is an amino group, the reactive group B may use an amino group or a hydroxyl group. Furthermore, in cases when the functional group A is a thiol group, the reactive group B may use a carboxyl group or an acyl group.

A compound which is reacted with a functional group A on the parent particle surface (hereinafter, also denoted as a reactive compound) contains a reactive group B and an AOS group and it is preferred to use a compound containing the reactive group B on one end and the AOS group on the other end, in terms of bonding between a parent particle and an inorganic layer being readily attained.

Such a reactive compound is preferably compounds, as described below.

For instance, there a reactive compound containing an epoxy group on one end and an AOS group on the other end and specific examples of such a compound include 2-(3,4-epoxycyclohexyl)-ethyltrimethoxysilane, 3-glycidoxypropyltrimethoxysilane, 3-glycidoxypropylmethyl-diethoxysilane and 3-glycidoxypropyltriethoxysilane.

For instance, there a reactive compound containing an amino group on one end and an AOS group on the other end and specific example of such a compound include N-2-(aminoethyl)-3-aminopropylmethyldimethoxysilane, N-2-(aminoethyl)-3-aminopropyltrimethoxysilane, N-2-(aminoethyl)-3-aminopropyltriethoxysilane, 3-aminopropyltrimethoxysilane and 3-aminopropyltriethoxysilane.

For instance, there a reactive compound containing an isocyanate group on one end and an AOS group on the other end and specific example of such a compound include 3-isocyanato-propyltriethoxysilane.

For instance, there a reactive compound containing a mercapto group on one end and an AOS group on the other end and specific example of such a compound include (3-mercaptopropyl)methyl-dimethoxysilane and (3-mercaptopropyl) trimethoxysilane.

When a functional group A on the parent particle surface is reacted with a reactive compound, parent particles having introduced a functional group A on the surface are dispersed in an aqueous medium containing a surfactant and thereto, a sufficient amount of the reactive compound is dropwise added with stirring at room temperature and the reaction mixture is further stirred at 50° C. over a prescribed period of time. Subsequently, after being cooled, filtration and washing of particles are repeated. Thereby, the functional group A on the parent particle surface is reacted with a functional group B of the reactive compound, resulting in introduction of an AOS group onto the parent particle surface. The reaction of the functional group A on the parent particle surface with the functional group B of the reactive compound proceeds quantitatively, so that the quantity of functional groups on the parent particle surface before reaction and the quantity of AOS groups on the parent particle surface are mostly invariable.

Formation of Covering Layer:

An inorganic layer is formed typically by a wet process and any wet process in which inorganic particles can be deposited is applicable without specific restriction.

There are applicable methods similar to commonly known wet processes for preparing metal oxide particles. Of these, a wet process such as a sol-gel method is preferably applicable.

When forming an inorganic layer by a sol-gel method, for example, a dispersion of a raw material for an inorganic layer is dropwise added to an aqueous dispersion of prescribed resin particles (parent particles) under a basic environment and stirred over a prescribed period of time. Thereby, while inorganic particles are deposited on the surface, parent particles are obtained which have formed a chemical bond to the inorganic particles. Raw materials for an inorganic layer include a metal oxide and specific examples thereof include silica, alumina, titania, zirconia and the like. Such an inorganic layer preferably is a particulate silica layer in terms of further enhanced bonding between an inorganic layer and parent particles.

For example, tetraethoxysilane, tetramethoxysilane, tetraisopropoxysilane, methyltriethoxysilane and dimethyldiethoxysilane are usable for formation of a particulate silica layer.

The addition amount of a raw material for an inorganic layer is not specifically limited so long as the object of the present invention is accomplished and is preferably from 0.1 to 50 parts by mass, based on 100 parts by mass of parent particles, and more preferably from 1 to 30 parts by mass.

The thickness of an inorganic layer is not specifically limited but preferably from 1 to 30 nm, and more preferably from 3 to 10 nm.

The thickness of an inorganic layer is determined in such a manner that using Microtrack UPA-150 (made by Nikkiso Co., Ltd.), the particle size of parent particles and that of particles forming an inorganic layer were measured and the difference thereof was defined as the inorganic layer thickness.

Specifically, the measurement was carried out in the following manner. First, a few drops of a particle dispersion was added into a 50 ml messcylinder, 25 ml of pure water was further added thereto and dispersed for 3 minutes by using an ultrasonic washing machine, US-1 (made by AS ONE Corp.) to prepare a measurement sample. Into a cell of Microtrack UPA-150 was placed 3 ml of the measurement sample. It was confirmed that the value of Sample Loading was within the range of 0.1 to 100. Measurement was conducted under the following conditions.

Measurement Conditions:

Transparency: Yes

Refractive Index: 1.59

Particle Density: 1.05 mg/cm$^3$

Spherical Particles: Yes

Solvent Conditions:

Refractive Index: 1.33,

Viscosity: High (temp) $0.797\times10^{-3}$ Pa·s

Low (temp) $1.00\times10^{-3}$ Pa·s

Formation of Outermost Surface Layer:

There may be formed an outermost surface layer on the surfaces of the external additive particles related to the invention. Usually, the outermost surface layer is formed by a surface treatment using an organic surface treatment agent. Specifically, parent particles having formed an inorganic layer on the surface are further subjected to a surface treatment by use of an organic surface treatment agent. Such an organic surface treatment agent employs an organometallic compound which is used when inorganic particles as an external additive used in the field of electrophotographic toners are subjected to a surface treatment. There may be employed, for example, an organometallic compound containing at least one metal atom selected from silicon, aluminum and titanium. Such an organic surface treatment agent preferably is an organosilicon compound in terms of electrostatic-charging property and hydrophobilization. Examples of an organic group contained in an organometallic compound include an alkyl group having 1-10 carbon atoms, a phenyl group, a fluorine atom chlorine atom and a bromine atom.

Production Method of Toner:

Next, there will be described a production method of a toner related to the invention. The toner related to the invention is not specifically restricted is its production method and can be produced by commonly known methods, such as a polymerization method or a grinding method. In the following, there will be described a toner production method by a knead-grinding method capable of producing the toner related to the invention.

In the knead-grinding method, at least a binder resin and a colorant are mixed, subjected to a kneading treatment by a kneader and then ground up. Further, a classification treatment is optionally conducted to prepare the toner. The toner related to the invention can be prepared based on known knead-grinding conditions.

The toner of the invention is directed to a toner capable of achieving enhanced low-temperature fixability and improved offset resistance, in which a binder resin constituting a toner preferably exhibits a glass transition temperature of 60 to 70° C. The glass transition temperature of a binder resin can be determined by using, for example, a DSC-7 differential scanning calorimeter (produced by Perkin Elmer Corp.) or a TAC7/DX thermal analysis controller (made by Perkin Elmer Corp.). The measurement is conducted as follows. A toner in an amount of 4.5-5.0 mg is precisely weighed to two places of decimals, sealed into an aluminum pan (KIT NO. 0219-0041) and set into a DSC-7 sample holder. An empty aluminum pan is used as a reference. Temperature is controlled through heating-cooling-heating at a temperature-raising rate of 10° C./min and a temperature-lowering rate of 10° C./min in the range of 0 to 200° C.

An extension line from the base-line prior to the initial rise of the first endothermic peak and a tangent line exhibiting the maximum slope between the initial rise and the peak are drawn and the intersection of both lines is defined as the glass transition point.

Toner Particle Size and Measurement:

The volume average particle size of colored particles forming a toner is not specifically limited but is preferably from 3.0 to 8.0 μm.

The volume average particle size of colored particles forming a toner is represented by a volume-based median diameter (also denoted as d50 diameter), which can be measured and calculated by using Multisizer 3 (made by Beckman Coulter Co.) connected to a computer system for data processing.

A toner in an amount of 0.02 g is treated with a 20 ml surfactant solution (in which a neutral detergent containing a surfactant component is diluted 10 times with pure water) and then subjected to ultrasonic dispersion for 1 min. to prepare a toner dispersion. The toner dispersion is introduced by a pipette into a beaker containing ISOTON II (produced by Beckman Coulter Co.), placed in a sample stand until reaching a measured concentration of 5-10% and the analyzer count is set to 2500 particles. The aperture diameter of Multisizer 3 is 50 μm.

The toner related to the invention may use a binder resin of a commonly known polymer resin, such as a vinyl polymer or a polyester resin, including, for example, a polymer composed of a single vinyl monomer or a combination of plural vinyl monomers, a composite resin composed of a vinyl and a polyester resin and a polyester resin.

Specific examples of a polymerizable vinyl monomer are described below. Styrene monomers used to form a resin by using a polymer of the formula (1) include styrene and its derivatives, as shown below. Further, (meth)acryl monomers include not only an acrylic acid monomer and a methacrylic acid monomer but also acrylic acid ester derivatives and methacrylic acid ester derivatives, as shown below:

(1) Styrene and Styrene Derivative:

styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene;

(2) Methacryl Acid Ester Derivative:

methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate;

(3) Acrylic Acid Ester Derivative:

methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate;

(4) Olefins:

ethylene, propylene, isopbutylene;

(5) Vinyl Esters:

vinyl propionate, vinyl acetate, vinyl benzoate;

(6) Vinyl Ethers:

vinyl methyl ether, vinyl ethyl ether;

(7) Vinyl Ketones:

vinyl methyl ketone, vinyl ethyl ketone, vinyl hexyl ketone;

(8) N-Vinyl Compounds:

N-vinylcarbazole, N-vinylindole, N-vinylpyrrolidone;

(9) Others:

vinyl compounds such as vinylnaphthalene, vinylpyridine; acrylic acid or methacrylic acid derivatives such as acrylonitrile, methacrylonitrile and acrylamide.

Polymerizable vinyl monomers forming a resin usable in the toner relating to the present invention can also employ one containing an ionic dissociative group such as a carboxyl group, a sulfonic acid group or a phosphoric acid group.

Examples of such one containing a carboxyl group include acrylic acid, methacrylic acid, maleic acid, itaconic acid, cinnamic acid, fumaric acid, maleic acid monoalkyl ester and itaconic acid monoalkyl ester. Examples of such one containing a sulfonic acid group include styrene sulfonic acid, allylsulfosuccinic acid, and 2-acrylamido-2-methylpropane sulfonic acid. Examples of such one containing a phosphoric acid group include.

A resin of a crosslinking structure can also prepare by using poly-functional vinyl compounds. Examples thereof are as below:

Ethylene glycol dimethacrylate, ethylene glycol diacrylate, diethylene glycol dimethacrylate, diethylene glycol diacrylate, triethylene glycol dimethacrylate, triethylene glycol diacrylate, neopentylene glycol dimethacrylate, and neopentylene glycol diacrylate.

Colorants usable in the toner relating to the present invention include those known in the art and specific examples thereof are as follows:

Examples of black colorants include carbon black such as Furnace Black, Channel Black, Acetylene Black, Thermal Black and Lamp Black and magnetic powder such as magnetite and ferrite.

Magenta and red colorants include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48, C.I. Pigment Red 53:1, C.I. Pigment Red 57:1, C.I. Pigment Red 60, C.I. Pigment Red 63, C.I. Pigment Red 64, C.I. Pigment Red 68, C.I. Pigment Red 81, C.I. Pigment Red 83, C.I. Pigment Red 87, C.I. Pigment Red 88, C.I. Pigment Red 89, C.I. Pigment Red 90, C.I. Pigment Red 112, C.I. Pigment Red 114, C.I. Pigment Red 122, C.I. Pigment Red 123, C.I. Pigment Red 139, C.I. Pigment Red 144, C.I. Pigment Red 149, C.I. Pigment Red 150, C.I. Pigment Red 163, C.I. Pigment Red 166, C.I. Pigment Red 170 C.I. Pigment Red 177, C.I. Pigment Red 178, C.I. Pigment Red 184, C.I. Pigment Red 202, C.I. Pigment Red 206, C.I. Pigment Red 207, C.I. Pigment Red 209, C.I. Pigment Red 222 C.I. Pigment Red 238 and C.I. Pigment Red 169.

Orange or yellow colorants include C.I. Pigment Orange 31, C.I. Pigment Orange 43, C.I. Pigment Yellow 12, C.I. Pigment Yellow 14, C.I. Pigment Yellow 15, C.I. Pigment Yellow 17, C.I. Pigment Yellow 74, C.I. Pigment Yellow 83 C.I. Pigment Yellow 93, C.I. Pigment Yellow 94, C.I., Pigment Yellow 138, C.I. Pigment Yellow 155, C.I. Pigment Yellow 162, C.I. Pigment Yellow 180 and C.I. Pigment Yellow 185.

Green or cyan colorants include C.I. Pigment Blue 2, C.I. Pigment Blue 3, C.I. Pigment Blue 15, C.I. Pigment Blue 15:2, C.I. Pigment Blue 15:3, C.I. Pigment Blue 15:4, C.I. Pigment Blue 16, C.I. Pigment Blue 17, C.I. Pigment Blue 60, C.I. Pigment Blue 62, C.I. Pigment Blue 66 and C.I. Pigment Green 7.

Dyes include C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 2, C.I. Solvent Yellow 6, C.I. Solvent Yellow 14, C.I. Solvent Yellow 15, C.I. Solvent Yellow 16, C.I. Solvent Yellow 19, C.I. Solvent Yellow 21, C.I. Solvent Yellow 33, C.I. Solvent Yellow 44, C.I. Solvent Yellow 56, C.I. Solvent Yellow 61, C.I. Solvent Yellow 77, C.I. Solvent Yellow 79, C.I. Solvent Yellow 80, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, Solvent Blue 25, C.I. Solvent Blue 36, C.I. Solvent Blue 60, C.I. Solvent Blue 70, C.I. Solvent Blue 93 and C.I. Solvent Blue 95.

The foregoing colorants may be used alone or in combination. The colorant content is preferably from 1% to 30% by mass, and more preferably 2% to 20% by mass of the whole of a toner. A number average primary particle size, depending of its kind, is approximately from 10 to 200 nm.

The colorant particle surface may be treated by a coupling agent or the like.

There will be described wax usable for the toner relating to the invention. Waxes usable in the toner of the present invention are those known in the art. Examples thereof include: (1) polyolefin wax such as polyethylene wax and polypropylene wax, (2) long chain hydrocarbon wax such as paraffin wax and sasol wax, (3) dialkylketone type wax such as distearylketone, (4) ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristearate, and distearyl meleate, and (5) amide type wax such as ethylenediamine dibehenylamide and trimellitic acid tristearylamide.

The melting point of a wax usable in the invention is preferably 40 to 160° C., more preferably 50 to 120° C., and still more preferably 60 to 90° C. A melting point falling within the foregoing range ensures heat stability of toners and can achieve stable toner image formation without causing cold offsetting even when fixed at a relatively low temperature. The wax content of the toner is preferably in the range of 1% to 30% by mass, and more preferably 5% to 20%.

There may be incorporated, in the process of preparing the toner of the invention, inorganic organic microparticles having a number-average primary particle size of 4 to 800 nm as an external additive to prepare the toner.

Incorporation of an external additive results in improved fluidity or electrostatic property or achieves enhanced cleaning ability. The kind of external additives is not specifically limited and examples thereof include inorganic microparticles, organic microparticles and a sliding agent, as described below.

There are usable commonly known inorganic microparticles and preferred examples thereof include silica, titania, alumina and strontium titanate microparticles. There may optionally be used inorganic microparticles which have been subjected to a hydrophobilization treatment.

Specific examples of silica microparticles include R-976, R-974, R-972, R-812 and R-809 which are commercially available from Nippon Aerosil Co., Ltd.; HVK-2150 and H-200 which are commercially available from Hoechst Co.; TS-720, TS-530, TS-610, H-5 and MS-5 which is commercially available from Cabot Co.

Examples of titania microparticles include T-805 and T-604 which are commercially available from Nippon Aerosil Co. Ltd.; MT-100S, MT-100B, MT-500BS, MT-600, MT-600SJA-1 which are commercially available from Teika Co.; TA-300SI, TA-500, TAF-130, TAF-510 and TAF-510T which as commercially available from Fuji Titan Co., Ltd.; IT-S, IT-OB and IT-OC which as commercially available from Idemitsu Kosan Co., Ltd.

Examples of alumina microparticles include RFY-C and C-604 which are commercially available from Nippon Aerosil Co., Ltd.; and TTO-55, commercially available from Ishihara Sangyo Co., Ltd.

There are also usable lubricants, such as long chain fatty acid metal salts to achieve enhanced cleaning ability or transferability. Examples of a long chain fatty acid metal salt include zinc, copper, magnesium, and calcium stearates; zinc, manganese, iron, copper and magnesium oleates; zinc, copper, magnesium, and calcium palmitates; zinc and calcium linolates; zinc and calcium ricinolates.

Such an external additive or lubricant is incorporated preferably in an amount of 0.1 to 10.0% by weight of the total toner. The external additive or lubricant can be incorporated by using commonly known mixing devices such as a turbuler mixer, a HENSCHEL MIXER, a Nauter mixer or a V-shape mixer.

Developer and Developing Method:

In the invention, a developing method is not specifically restricted and toner images can be formed by magnetic single-component development, or by use of a two component developer composed of a carrier and a toner or a non-magnetic single component developer composed of a toner alone.

In cases when using a toner related to the invention as a two component developer, full-color prints can be prepared at a high-speed by using, for example, a tandem type image forming apparatus. A carrier of magnetic particles used in a two-component developer can employ materials known in the art, such as a metal, for example, iron, ferrite or magnetite, or alloys of the foregoing metals and aluminum or lead. Of these, ferrite particles are preferred. The volume average particle diameter of a carrier is preferably from 15 to 100 nm, and more preferably 25 to 80 nm.

When used as a non-magnetic single component developer performing image formation without using a carrier, toner particles are rubbed or compressed onto a charging member or a developing roller to perform electrostatic-charging. Image formation by a non-magnetic single component developing system can simplify the structure of a developing device, having the merit of downsizing the whole of an image forming apparatus. Accordingly, the use of the afore-described toner as a non-magnetic single component developer can realize full-color printing by a compact color printer and full-color printing superior in color reproduction is feasible even in a space-restricted working environment.

Image Forming Method:

Next, there will be described an image forming method related to the invention. The image forming method related to the invention can form a toner image using a toner related to the invention by a process comprising the steps described below:

(1) latent image forming step of forming an electrostatic latent image on the surface of an electrophotographic photoreceptor, (2) developing step of developing the electrostatic latent image formed on the photoreceptor surface with a developer carried by a developer carrier to form a toner image, (3) transfer step of transferring the toner image to the surface of a transfer material (typically, transfer paper, a recording medium, an image support or the like), and (4) fixing step of heat-fixing the toner image transferred onto the transfer material surface.

EXAMPLES

In the following, representative embodiments of the invention will be described with reference to examples to demonstrate the effects of the invention, but the invention is not limited to these embodiments. Unless otherwise noted, "part(s)" represents part(s) by mass and "%" represents % by mass.

Preparation of External-Additive Particle (1):

Synthesis of Resin Particle:

There were mixed 80 parts of styrene, 20 parts of 3-methacryloxypropyltriethoxysilane (KBE-503, made by Shinetsu Kagaku Co., Ltd.) and 20 parts of azobiscyanovaleronitrile (V-60, made by Wako Junyaku Co.) and the mixture was added to 600 parts of an aqueous surfactant solution (0.2% sodium dodecylbenzenesulfonate) and subjected to high-speed shearing at 10,000 rpm by using CLEAMIX (CLM-150S, made by M-Technique Co., Ltd.) to prepare a monomer dispersion.

The dispersion was placed into a polymerization device equipped with a stirrer, a condenser, a temperature sensor and a nitrogen gas-introducing tube and reacted at 70° C. over 6 hours, while being stirred under a stream of nitrogen gas. The reaction mixture was taken out and allowed to stand over night, while being maintained at 70° C. to obtain a dispersion of parent particles having completed a polymerization reaction.

Formation of Inorganic Layer:

In 1000 g of pure water was dispersed 150 g of a parent particle dispersion, and 10 g of ammonia (28%) was added thereto and stirred for 5 minutes. Subsequently, 30 g of tetraethoxysilane was dropwise added over 3 hours and stirred at room temperature for 5 hours. The solvent of this dispersion was distilled away under reduced pressure, whereby inorganic layer-having particles which were provided with an inorganic layer (silica layer) on the parent particle surface, were obtained.

Formation of Outermost Surface Layer:

At room temperature, 10 g of the foregoing inorganic layer-having particles was added to a mixture of 50 g of cyclohexane and 10 g of hexamethyldisilane and the obtained dispersion was heated to 50° C. and allowed to react for 3 hours, while stirring. Subsequently, the solvent of this dispersion was distilled away at 50° C. under reduced pressure, whereby an external-additive particle (1) related to the invention which formed an outermost organic layer, was obtained.

The thus obtained particles were sufficiently dispersed in an acryl resin curable at ordinary temperature, embedded and cured, and thereafter, thin sample pieces were sliced by a microtome provided with a diamond blade. Among the thus obtained particle sections, the section capable of observing the particle interior and close to an average particle size was chosen, and using a transmission electron microscope (JEM 2010F, made by Nippon Denshi Co., Ltd.) and an energy dispersion type X-ray analyzer (System SIX, made by Thermo Noran), an element mapping measurement of a resin portion was conducted at an acceleration voltage of 200 kV by a factor of 100,000 to confirm silicon atoms within the parent particle. From the result thereof, it was judged that AOS groups were introduced into parent particles and the parent particles were each bonded to an inorganic layer through a siloxane bond.

Preparation of External-Additive Particles (2), (3), (5) and (6):

External-additive particles (2), (3), (5) and (6) were each prepared in the same manner as the foregoing external-additive particle (1), except that 3-methacryloxypropyltriethoxysilane used in the synthesis of resin particle was replaced by an AOS group-containing monomer in an amount, as shown in Table 1 and in correspondence thereto, the amount of styrene was also varied.

Preparation of External-Additive Particle (4):

External-additive particle (4) was prepared in the same manner as the external-additive particle (1), except that the "Synthesis of resin particle" was changed as below.

Synthesis of Resin Particle:

A mixture of 70 parts of styrene, 30 parts of 3-glycidy; methacrylate and 2.0 parts of azobiscyanovaleronitrile (V-60, made by Wako Junyaku Co.) was added to 600 parts of an aqueous surfactant solution (0.2% sodium dodecylbenzenesulfonate) and subjected to high-speed shearing at 10,000 rpm by using CLEAMIX (CLM-150S, made by M-Technique Co., Ltd.) to prepare a monomer dispersion.

The dispersion was placed into a polymerization device equipped with a stirrer, a condenser, a temperature sensor and a nitrogen gas-introducing tube and reacted at 70° C. over 6 hours, while being stirred under a stream of nitrogen gas. The reaction mixture was taken out and allowed to stand over night, while being maintained at 70° C. to obtain a dispersion of a parent particle precursor having completed polymerization reaction.

To 500 g of this parent particle precursor dispersion was dropwise added 25 g of 3-aminopropylmethyldimethoxysilane with stirring at room temperature and was allowed to react over 10 hours with stirring at 50° C., whereby a parent particle dispersion was obtained.

Preparation of External-Additive Particles (7), (8), (11) and (12):

External-additive particles (7), (8), (11) and (12) were each prepared in the same manner as the foregoing external-additive particle (1), except that the concentration of the aqueous surfactant solution (0.2% sodium dodecylbenzenesulfonate) was varied to 0.1%, 1.0%, 0.07% and 1.2%, respectively.

Preparation of External-Additive Particles (9) and (10):

External-additive particles (9) and (10) were each prepared in the same manner as the foregoing external-additive particles (1) and (2), except that formation of outermost surface layer was not conducted.

Preparation of External-Additive Particle (13):

External-additive particle (13) was each prepared in the same manner as the foregoing external-additive particle (1), except that 3-methacryloxypropyltriethoxysilane used in the synthesis of resin particle was not added and was replaced by 100 g of styrene.

Preparation of External-Additive Particle (14):

External-additive particle (14) was each prepared in the same manner as the foregoing external-additive particle (8), except that 3-methacryloxypropyltriethoxysilane used in the synthesis of resin particle was not added and was replaced by 100 g of styrene.

Similarly to the external-additive particle (1), external-additive particles (2)-(14) were each confirmed with respect to presence/absence of the outermost surface layer, as shown in Table 1.

External-additive particles (1) to (14) are shown in Table 1.

TABLE 1

| External-additive Particle | Number Average particle Size (nm) | AOS Group-containing Monomer or Functional Group-containing Monomer Compound | Content (%) | Formation of Outermost Organic Surface Layer |
|---|---|---|---|---|
| (1) | 105 | 3-methacryloxypropyltriethoxysilane | 20 | Yes |
| (2) | 110 | 3-acryloxypropyltriethoxysilane | 3 | Yes |
| (3) | 104 | styryltrimethoxysilane | 10 | Yes |
| (4) | 105 | 3-glycidylmethacrylate | 30 | Yes |
| (5) | 102 | 3-methacryloxypropyltriethoxysilane | 45 | Yes |
| (6) | 108 | 3-methacryloxypropyltriethoxysilane | 1 | Yes |
| (7) | 485 | 3-methacryloxypropyltriethoxysilane | 20 | Yes |
| (8) | 31 | 3-methacryloxypropyltriethoxysilane | 20 | Yes |
| (9) | 105 | 3-methacryloxypropyltriethoxysilane | 20 | No |
| (10) | 110 | 3-acryloxypropyltriethoxysilane | 20 | No |
| (11) | 510 | 3-methacryloxypropyltriethoxysilane | 20 | Yes |
| (12) | 27 | 3-methacryloxypropyltriethoxysilane | 20 | Yes |
| (13) | 102 | — | — | Yes |
| (14) | 30 | — | — | Yes |

Preparation of Toner 1:

To 1150 parts of pure water was added 390 parts of aqueous 0.1 mol/L $Na_3PO_4$ solution and stirred at 10,000 rpm by using CLEAMIX (CLM-150S, made by M-Technique Co., Ltd.).

Further thereto, 58 parts of an aqueous 1.0 mol/L ca $Cl_2$ solution was gradually added to prepare a dispersion containing $Ca_3(PO_4)_2$.

Then, the compounds below were mixed and dissolved to prepare a polymerizable monomer composition.

| | |
|---|---|
| Styrene | 80 parts |
| n-Butyl acrylate | 20 parts |
| 2,2-Azobis(2,4-dimethylvaleronitrile) | 2.7 parts |

The polymerizable monomer composition was added to the foregoing dispersion, while stirring at 6,000 rpm by using CLEAMIX and further stirred for 20 minutes to prepare a dispersion of a polymerizable monomer composition in which the polymerizable monomer composition was dropwise dispersed.

The prepared dispersion of a polymerizable monomer composition was placed into a reaction vessel equipped with a stirrer, a condenser, a temperature sensor and a nitrogen gas-introducing tube and polymerization was performed for 5 hours, while stirring under a stream of nitrogen gas and maintaining a temperature within the reaction vessel at 60° C., and then, the reaction vessel was cooled to room temperature. After hydrochloric acid was added to the formed binder resin to dissolve $Ca_3(PO_4)_2$, a binder resin was prepared via washing, filtration and drying. The number average molecular weight (Mn) of the binder resin was 29,000 and the weight average molecular weight (Mw) was 32,000.

(2) Preparation of Toner:

| | |
|---|---|
| Binder resin | 1000 parts |
| Carbon black | 50 parts |
| Zinc salicylate complex (Bontron E-84, Made by Orient Kagaku Co.) | 40 parts |
| Behenyl behenate (m.p.: 71° C., made By Nichiyu Co., Ltd.) | 30 parts |

A mixture of the foregoing composition was prepared and placed into a Henshell mixer with a volume of 9 liters (made by Mitsui Kozan Co., Ltd.) and mixed, while stirring for 5 minutes at a rotation rate of the stirring blade of 2,000 rpm.

The mixture of the foregoing composition was melt-kneaded at 130° C. in an extrusion kneader (PCM-30, made by Ikegai Kakoki Co., Ltd.) and after being cooled, a coarse-grinding treatment was conducted by Feather Mill (made by Hosokawa Micron Corp.). The thus obtained coarse-ground material was finely ground in a mechanical pulverizer, Kripton type KTM-O (made by Kawasaki Juko Co., Ltd.) until it reached an average particle size of 7 μm. Thereafter, coarse powdery components were removed by using an airflow type classifier (IDS-2 type, made by Nippon Pneumatic Mfg. Co., Ltd.). Further, coarse powdery components were removed by using a mechanical classifier (50ATP, made by Hosokawa Micron Corp.). There were thus obtained colorant particles having an average particle size of 6.8 μm.

Subsequently, to 1,000 parts of the thus prepared particles was added an external additive of the following composition and subjected to an external-addition treatment by using a Henschel mixer at 3000 rpm to prepare a toner.

| | |
|---|---|
| External additive particle (1) | 30 parts |
| Hydrophobic silica (R805, made by Nippon Aerosil Co.) | 10 parts |
| Titanium oxide (STT-30S, made by Chitan Kogyo Co., Ltd.) | 5 parts |

The thus prepared toner was denoted as Toner 1 for use in Example 1.

Preparation of Toners 2-14:

Toners 2-14 were each prepared in the same manner as Toner 1, except that the external-additive particle (1) was replaced each of the foregoing external-additive particles (2) to (14).

Examples 1-12 and Comparative Examples 1-2

Using Toners 1-14, Examples 1-12 and Comparative example 1-2 were evaluated with respect to the following performance, as shown in Table 2.

Performance Evaluation:

Each of the foregoing toners was loaded into a digital color hybrid machine, bizhub C352 (produced by Konica Minolta Business Technologies Inc.) and evaluation was made with respect to reflection density of a solid image (black image) outputted under environment of 20° C. and 55% RH.

Using A4-size fine-quality paper (64 g/m$^2$), 10,000 sheets of mixed images composed of a text image having a picture element ratio of 7%, a portrait photographic image and a solid cyan half-tone image having a relative image density of 0.6, formed on J Paper of 64 g/m$^2$ (produced by Konica Minolta Corp.) were printed as a test image, and samples in the initial stage and after printing 10,000 sheets were evaluated based on the following criteria:

A: reflection density of not less than 1.4,

B: reflection density of not less than 1.25 and less than 1.39,

C: reflection density of less than 1.25.

In the foregoing, rank "A" or "B" is acceptable in practice.

TABLE 2

| Example No. | Toner No. | Image density: Initial Stage | Image density: After Completion of Printing | Image Density Difference* | Evaluation |
|---|---|---|---|---|---|
| 1 | 1 | 1.52 | 1.48 | 0.04 | A |
| 2 | 2 | 1.53 | 1.44 | 0.09 | A |
| 3 | 3 | 1.50 | 1.42 | 0.08 | A |
| 4 | 4 | 1.50 | 1.42 | 0.08 | A |
| 5 | 5 | 1.49 | 1.40 | 0.09 | A |
| 6 | 6 | 1.51 | 1.34 | 0.17 | B |
| 7 | 7 | 1.48 | 1.30 | 0.18 | B |
| 8 | 8 | 1.51 | 1.30 | 0.21 | B |
| 9 | 9 | 1.52 | 1.30 | 0.22 | B |
| 10 | 10 | 1.50 | 1.28 | 0.22 | B |
| 11 | 11 | 1.49 | 1.25 | 0.24 | B |
| 12 | 12 | 1.48 | 1.24 | 0.24 | B |
| Comp. 1 | 13 | 1.50 | 1.04 | 0.46 | C |
| Comp. 2 | 14 | 1.49 | 1.14 | 0.35 | C |

*Difference in image density between initial stage and after completion of printing As is apparent from the results shown in Table 2, it was proved that Examples 1-5 were each excellent in performance and performances of Examples 6-12 were also acceptable in practice. It was also proved that Comparative Examples 1 and 2 were unacceptable in practice.

What is claimed is:

1. A toner for electrostatic latent image development comprising:

colored particles containing a binder resin and a colorant; and external-additive particles attached to the surfaces of the colored particles, wherein the external-additive particles comprise resin particles covered with an inorganic layer, an organic layer containing a compound including at least one metal atom selected from the group consisting of silicon, aluminum and titanium on the inorganic layer, and the resin particles are bound to the inorganic layer by a siloxane bond.

2. The toner of claim 1, wherein the external-additive particles exhibit a number average particle size of 30 nm to 500 nm.

3. The toner of claim 1, wherein the inorganic layer is a silica layer.

4. A method of preparing a toner for electrostatic latent image development comprising the steps of:

forming colored particles containing a binder resin and a colorant, and additional external-additive particles to the colored particles to form toner particles with the external-additive particles attached to the surfaces of the colored particles, wherein the external-additive particles comprise resin particles covered with an inorganic layer, the external-additive particles are prepared by a process comprising mixing resin particles and an inorganic compound in an aqueous medium, depositing inorganic particles on the resin particles to form the resin particles covered with the inorganic layer comprising a metal oxide, and subjecting the resin particles covered with the inorganic layer to a surface treatment with an organometallic compound containing at least a metal atom selected from the group consisting of silicon, aluminum, and titanium to form an organic layer containing the metal atom on the inorganic layer, and the resin particles are prepared by a process of polymerizing polymerizable monomers including a monomer containing an alkoxysilyl group.

5. The method of claim 4, wherein the inorganic compound is a compound selected from the group consisting of tetramethoxysilane, tetraethoxysilane, tetraisopropoxysilane, methyltriethoxysilane and dimethhyldiethoxysilane.

6. The method of claim 4, wherein the metal oxide is a silica.

7. The method of claim 4, wherein the resin particles are bound to the inorganic layer by a siloxane bond.

8. The method of claim 4, wherein the external-additive particles exhibit number average particle size of 30 nm to 500 nm.

9. An image forming method comprising the steps of forming an electrostatic latent image, developing the electrostatic latent image with a toner to form a toner image, transferring the toner image to a transfer material, and heat-fixing the transferred toner image, wherein the toner is a toner as claimed in claim 1.

* * * * *